US006332382B1

(12) United States Patent
Anderson et al.

(10) Patent No.: US 6,332,382 B1
(45) **Date of Patent: *Dec. 25, 2001**

(54) TOOL WITH POLYGONAL HEAD FOR INTERCHANGEABLE BITS

(76) Inventors: Wayne Anderson, 65 Grove St.; Warren R. Anderson, 7 Worcester Dr., both of Northport, NY (US) 11768

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/596,942

(22) Filed: Feb. 5, 1996

(51) Int. Cl.[7] ..... B25B 23/00
(52) U.S. Cl. ..... 81/438; 81/DIG. 11; 81/125
(58) Field of Search ..... 81/437–439, 125, 81/900, DIG. 11, 177.85

(56) References Cited

U.S. PATENT DOCUMENTS

| | | | | |
|---|---|---|---|---|
| 45,165 | | 1/1914 | Warren . | |
| 2,806,706 | * | 9/1957 | Fitch | 81/438 X |
| 3,114,401 | * | 12/1963 | Johnson | 81/177.85 X |
| 3,347,293 | * | 10/1967 | Clark | 81/438 |
| 3,875,829 | * | 4/1975 | Evans et al. | 81/185 |
| 4,084,454 | * | 4/1978 | Day | 81/437 X |
| 4,526,069 | | 7/1985 | Cecil . | |
| 4,699,029 | * | 10/1987 | Kelly et al. | 81/177.85 X |
| 4,926,721 | * | 5/1990 | Hsiao | 81/439 X |
| 5,105,690 | | 4/1992 | Lazzara . | |
| 5,172,615 | | 12/1992 | Albrecht . | |
| 5,341,705 | * | 8/1994 | Lin | 81/438 |
| 5,361,656 | * | 11/1994 | Starr | 81/177.85 X |
| 5,520,075 | * | 5/1996 | Barmore | 81/438 X |
| 5,603,248 | * | 2/1997 | Eggert et al. | 81/438 |

OTHER PUBLICATIONS

Lisle Catalog T–36, 1988, p. 20, 26000, Apr. 1988.*
Armstrong Tools Catalog, pp. 67, 71 and 82, 1973, Catalog 820 C.*
Nasco Catalog, p. 18, 1985/1986.*
Lisle Supplement T–54, Jun. 1995 p. 53.

* cited by examiner

*Primary Examiner*—D. S. Meislin
(74) *Attorney, Agent, or Firm*—Lackenbach Siegel

(57) ABSTRACT

A tourque transmitting tool set has a set of drivers having similarly sized male member portions and differently sized driver portions, and a single female member with a hole sized to receive each respective male member portion and a torque wrench receiving exterior where with a driver received in the female member a plane bisects the female member wrench receiving exterior and the male member portion so that each respective driver with the female member transmits torque in a limited access space.

11 Claims, 7 Drawing Sheets

TOOL WITH POLYGONAL HEAD FOR INTERCHANGEABLE BITS

BACKGROUND OF THE INVENTION

This invention relates to torque transmitting tools; and, more particularly, it relates to torque transmitting tools that allow for the interchangeability of male bits for the application of torque to fasteners and bolts in difficult to reach locations. Recently, there has been a growing trend in the automotive industry to decrease the size of automobiles. The decrease in the size of automobiles has resulted in the miniaturization of engines and components thereof. All of these developments have produced a need to create a variety of smaller and/or adaptable torque transmitting tools permitting the servicing of these smaller engines and components thereof.

The rapid storage, retrieval and insertion of a predetermined tool during an engine repair project that includes an obstruction limiting the accessibility of a fastener or a bolt, is also a very desirable goal. However, this goal is not easily achieved. Devices created to assist in the transmission of torque to fasteners and bolts are generally large and bulky, (see prior art illustrated in FIG. 19) and new engine compartments and engine components only offer a limited amount of vertical or horizontal clearance for the application of torque to fasteners and bolts. In particular, single piece Torx® tools, a trademark of the Camcar Division of Textron Corporation, a U.S.A. company, cannot clear obstructions and be inserted in cramped areas. Hence, there exists a need for a torque transmitting tool and kit that can store, organize and retain a desired tool that fits easily into the limited vertical and horizontal space constraints of an engine compartment. It is an object of the present invention to solve the variety of problems that exist in the art.

SUMMARY OF THE INVENTION

The present invention provides a torque transmitting tool, tool kit and method of applying torque to a fastener or bolt. The kit comprises in combination, a plurality of interchangeable male bits, a female bit retaining member having a polygonally shaped exterior portion having at least a pair of opposing parallel substantially flat surfaces for engaging a wrench and a female bit retaining pocket thereon for interchangeably engaging and temporarily retaining a desired bit.

Each male bit has a male bit retaining portion substantially congruent to the bit retaining pocket and a different sized male engaging portion extending beyond the bit retaining pocket compatible with a fastener to which torque is applied. The kit includes means for interchangeably retaining a desired male bit in the bit retaining pocket. The manipulation of screws or bolts located in hard to reach places is greatly facilitated and the problems associated with permanently attached torque transmitting bits are alleviated since the torque transmitting tool kit provides for a multitude of sizes to satisfy substantially any sized fastener utilizing an economical, light weight, single female bit retaining member.

The objects and features of the present invention, other than those specifically set forth above, will become apparent in the detailed description of the invention set forth below.

DETAILED DESCRIPTION OF THE INVENTION

Figure 1:
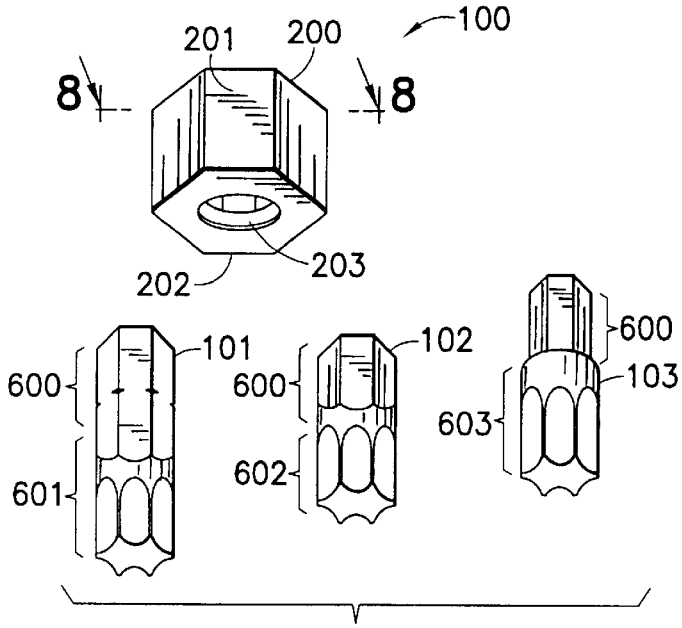
FIG. 1 is a perspective view of a torque transmitting kit having a female bit retaining member and a plurality of male Torx® bits.
Figure 2:
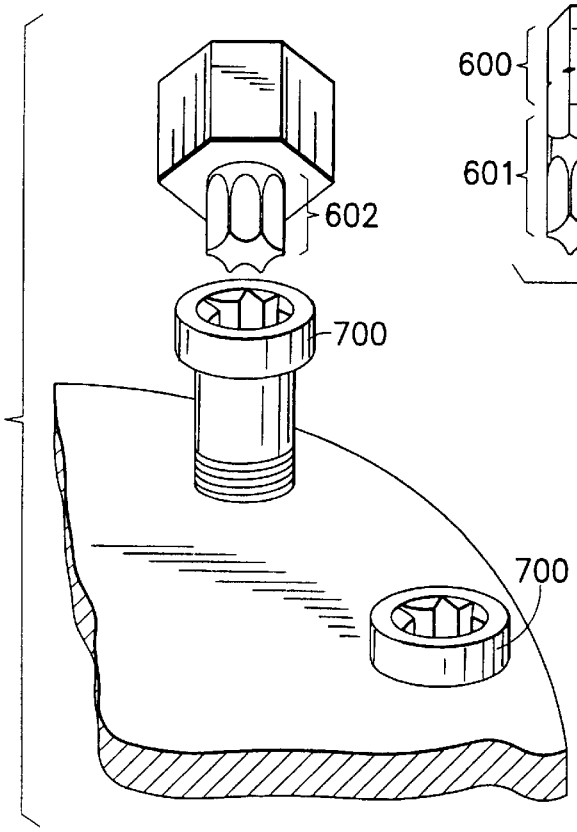
FIG. 2 is a perspective view of a female bit retaining member assembly having the female bit retaining member and a desired male Torx® bit of FIG. 1 prior to interaction with a fastener.
Figure 3:
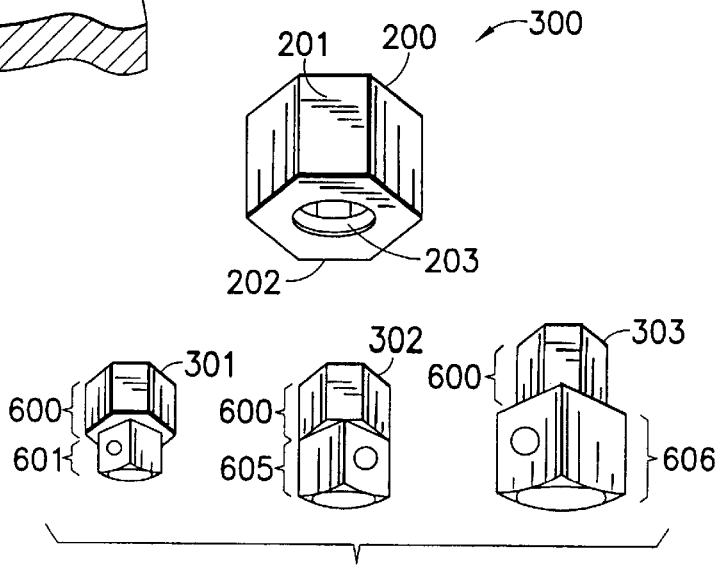
FIG. 3 is a perspective view of a torque transmitting kit having female bit retaining member and a plurality of male socket engaging bits.
Figure 5:
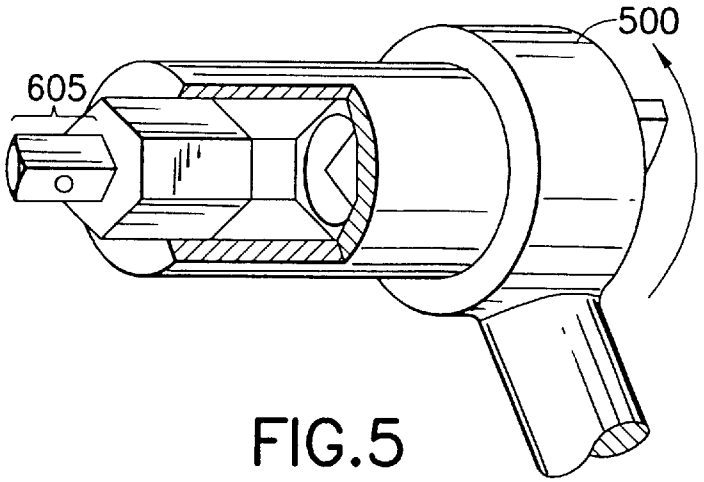
FIG. 5 is a perspective view of a female bit retaining member assembly having the female bit retaining member and a desired male socket engaging bit of FIG. 3 having torque applied thereto by a socket drive device.
Figure 6:
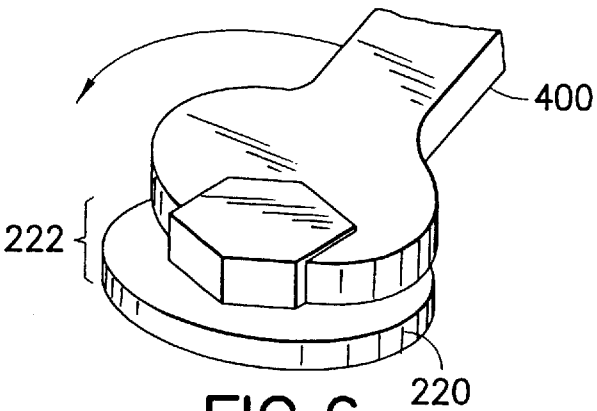
FIG. 6 is a perspective view of a variant of the female bit retaining member assembly having the female bit retaining member and a desired male socket engaging bit of FIG. 1 having an optional spinned, substantially circular flange permanently connected to the female bit retaining member to form a female bit retaining member assembly for positioning said wrench at a predetermined location thereon and a monkey wrench applying torque thereto.

FIGS. 1 and 3 are perspective views of torque transmitting tool kits or sets 100, 300 that include in combination, a plurality of interchangeable male bits 101, 102, 103, 301, 302, 303, respectively. The kits 100, 300 also include female bit retaining member 200 having a polygonally shaped exterior portion having at least a pair of opposing parallel substantially flat surfaces 201, 202 for engaging wrench 400 (FIGS. 6 and 17) or a socket wrench tool 500 (FIG. 5). It is appreciated that female bit retaining portion 200 is actuated externally and has torque applied thereto at said polygonally shaped exterior portion in contrast to an internal actuation and the application of torque to an interior area of the female bit retaining portion 200. Female bit retaining member 200 includes a female bit retaining pocket 203 (FIGS. 1, 3, 7, 8, 10, 12 and 13) thereon for interchangeably engaging and temporarily retaining a desired bit of interchangeable male bits 101, 102, 103, 301, 302, and 303 as illustrated in FIGS. 2, 4, 5, 12, and 13). Pocket 203 can be generally of any polygonal geometric shape, but is preferably of a hexagonal shape.

Each respective male bit 101–103 and male bit 301–303 has a male bit retaining portion 600 (FIGS. 1, 3, 9, 12, and 13–16) substantially congruent to female bit retaining pocket 203. Preferably, each of male bits 101–103 and 301–303 have a different sized male engaging portion 601–606 (FIGS. 1–5, 9, 12, 13 and 14) that extends beyond the bit retaining pocket 203 and is compatible with a fastener 700 (FIG. 2, and 14–17), a socket tool 800 (FIG. 4) to which torque is applied, or a bolt. In yet another variant, different sized male engaging portions of male bits 101–103 and 301–303 extend beyond bit retaining pocket 203 and are substantially rectangular in shape and accommodate both metric and SAE size sockets having a width selected from the group of widths in the range of about 0.5 inches to about 1 inch. In yet a further variant, different sized male engaging portions extend beyond the bit retaining pocket 203 that are substantially in the shape of Torx® bits having decreasing diameters. This allows for the torque transmitting tool kit 100, 300 to universally accommodate a wide variety of sockets, fasteners and bolts.

The female bit retaining member 200 includes means for interchangeably retaining a desired male bit 101–103 and 301–303 in bit retaining pocket 203. It is appreciated that the manipulation of screws or bolts located in hard to reach places is greatly facilitated through the use of the single, light weight, removable and interchangeable female bit retaining member 200 and a respective male bit 101–103, and 301–303. The problems associated with permanently attached torque transmitting bits are alleviated since the torque transmitting tool kit 100 provides for a multitude of sizes of bits 101–103 and 301–303 to satisfy substantially any sized fastener 700, socket tool 800 or bolt utilizing an economical, light weight, single female bit retaining member 200. Optionally, the female bit retaining member 200 has an elongated length no greater than the male bit retaining portion 600.

Figure 4:
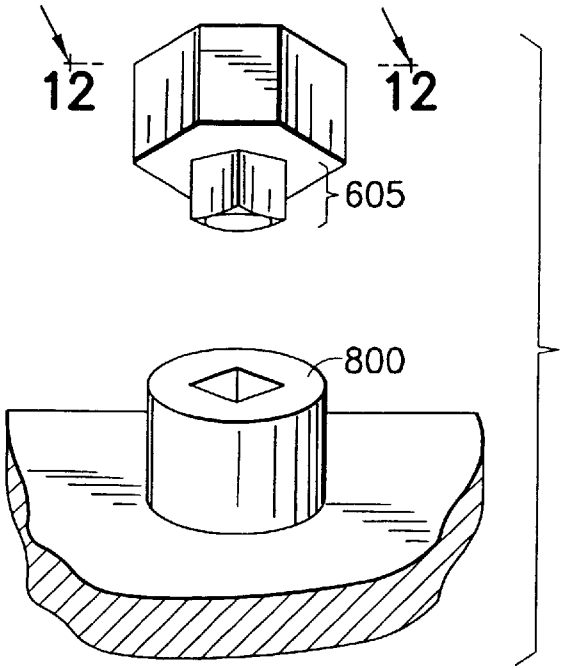
FIG. 4 is a perspective view of a female bit retaining member assembly having the female bit retaining member and a desired male socket engaging bit of FIG. 3 prior to interaction with a socket.
Figure 8:
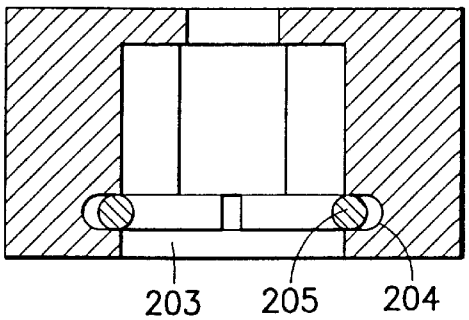
FIG. 8 is a side cross-sectional view of the female bit retaining member of FIG. 1 along phantom line 8.
Figure 10:
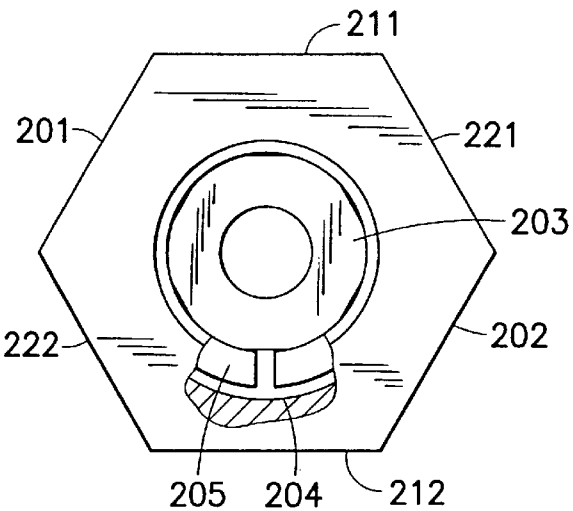
FIG. 10 is a bottom plan view of the female bit retaining member of FIG. 8 partially exposed to show the interior of the bit retaining pocket, an annular groove and spring.
Figure 7:
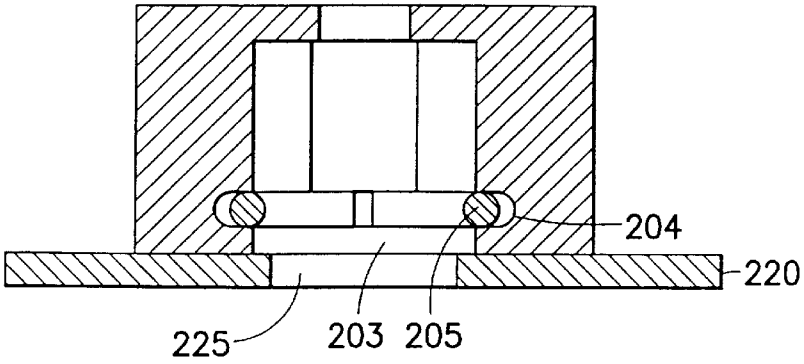
FIG. 7 is a side cross-sectional view of the female bit retaining member assembly for positioning said wrench at a predetermined location of FIG. 3.
Figure 9:
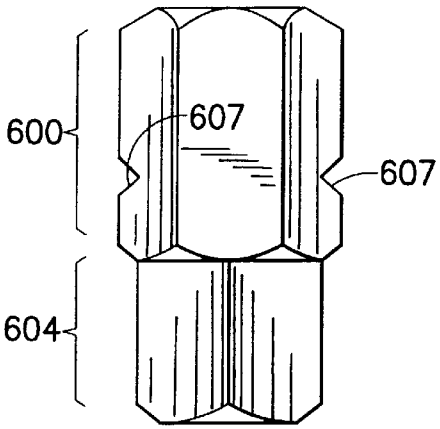
FIG. 9 is an enlarged side view showing a variant of a desired socket engaging bit of FIG. 3 having recesses thereon.
Figure 11:
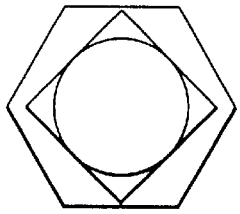
FIG. 11 is a bottom plan view of the desired socket engaging bit of FIG. 9.
Figure 12:
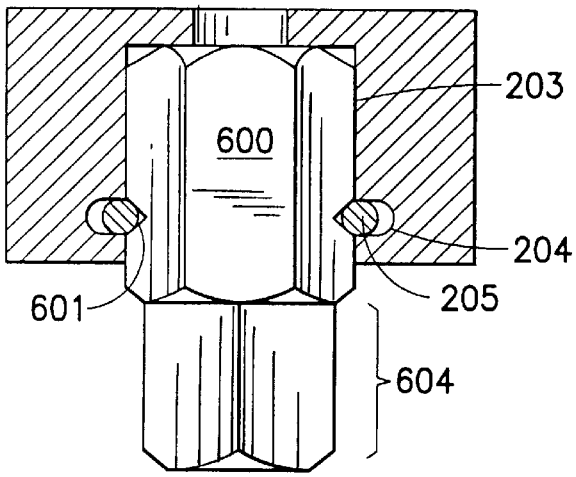
FIG. 12 is a side cross sectional view of the female bit retaining member assembly of FIG. 4 along phantom line 12.
Figure 13:
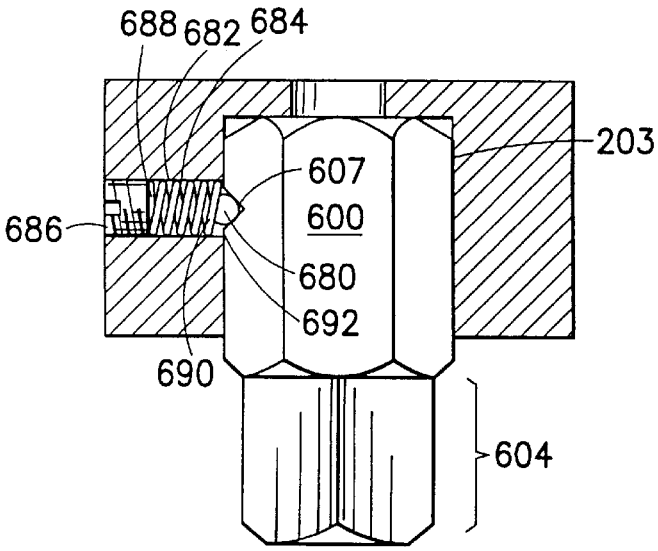
FIG. 13 is a side cross sectional view of a variant of the female bit retaining member of FIG. 12.

The means for interchangeably retaining a desired male bit 101–103, and 301–303 also include an internal annular groove 204 (FIGS. 7, 8, 10, and 12) substantially disposed in the interior of bit retaining pocket 203 in one variant. A resilient bit retaining spring 205 (FIGS. 7, 8, 10, and 12) is permanently seated within internal annular groove 204 for retaining a desired male bit 101–103, and 301–303 upon insertion thereof into bit retaining pocket 203 as illustrated in FIGS. 2, 4, and 12.

Optionally, each male bit 101–103 and 301–303 includes recess 607 compatible with resilient bit retaining spring 205, and in one variant is substantially congruent therewith. The resilient bit retaining spring 205 partially rests in recess 607 and partially rests in internal annular groove 204 upon insertion of a desired male bit 101–103, 301–303 into bit retaining pocket 203 for temporarily retaining the desired male bit and permitting for the rapid exchange of one desired male bit for another desired male bit.

In yet a further variant, the means for interchangeably retaining a desired male bit 101–103 and 301–303 also include a ball bearing 680 (FIG. 13) made of a suitable material such as steel or plastic. Bearing or projection 680 is resident in an aperture 682 disposed on female bit retaining member 200, and is biased toward a desired male bit 101 by spring 684. Spring 684 is retaining in aperture 682 at distal end 688 by end plug 686 which is threaded or otherwise permanently or temporarily secured in the aperture 682. Spring 684 is retained in aperture 682 at proximal end 690 by end wall 692.

In yet another variant, the means for interchangeably retaining desired male bit 101–103, 301–303 in the female bit retaining pocket 203 includes a magnetically attracting member for magnetically retaining a desired male bit in pocket 203. It is understood that male bits 101–103, 301–303 are magnetized in one variant and female member is made of a magnetically attacting material such as a metal and the like. In yet another variant, pocket 203 is magnetized and male bits are made from a magnetically attracted material such as a metal and the like.

As illustrated in FIGS. 4, 5, 12 and 13, male engaging portions 604 and 605 extend beyond bit retaining pocket 203 and are substantially rectangular in shape in one variant of the invention. Preferably, male engaging portions 604–606 are of a size and shape to universally accommodate both metric and SAE size socket extensions 800 (FIG. 4). It is appreciated that male engaging portions of male bits 101–103 and 301–303 can be of any geometric size or shape to accommodate slots in various types of fasteners, bolts and the like. These include, by way of example, phillips types of slots, triangular types of slots, and the like. Where there is limited vertical or horizontal clearance space (FIGS. 14–17), male bits 101–103, 301–303 have a height in the range of 5/16 of an inch to 1¼ of an inch. It is understood that the height of length or male bits 101–103, 301–303 can be much greater than that described where fasteners 700 or bolts are disposed within a deep well recess (FIG. 18), e.g. several inches or even several feet long.

As illustrated in FIGS. 1–5, 10, 16 and 17, the polygonally shaped exterior portion of female bit retaining member 200 has at least three pairs of opposing parallel substantially flat surfaces 201–202, 211–212, and 221–222 for engaging wrench 400. Optionally, female bit retaining member 200 further includes a substantially circular flange 220 (FIGS. 6–7) permanently connected to female bit retaining member 200 to form a female bit retaining member assembly 222 (FIGS. 6–7) for positioning wrench 400 at a predetermined location thereon. The substantially circular flange 220 has an aperture 225 thereon forming an opening communicating with bit retaining pocket 203 providing for entry of a desired male bit 101–103, 301–303 into bit retaining pocket 203. Flange 220 is generally constructed of a plastic or metal and can be intergral or removably connected to female bit retaining member 200.

FIGS. 14–17 illustrate that different steps utilized in the application of the method of the present invention. In particular, the invention provides for a method of applying torque to a fastener 700 or a bolt 900 (FIG. 18) having an axis parallel to the axis of pocket 203 and generally perpendicular to tool 400. The fastener 700 or bolt 900 is generally disposed in a limited clearance area with an obstruction 1000 along the parallel axis and spaced from the fastener 700.

Figure 14:
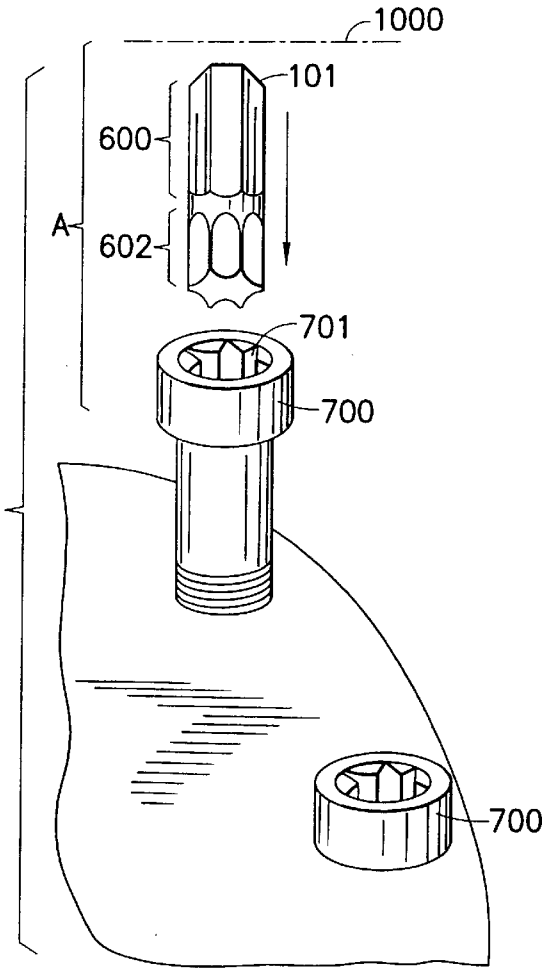
FIG. 14 is a diagram illustrating the step of inserting a male bit into a fastener according to the invention.

As illustrated in FIG. 14, a desired male bit 101 having male bit engaging portion 602 and having male bit retaining portion 600 is inserted into fastener recess 701 of fastener 700. Fastener recess 701 is substantially congruent to portion 602. The desired male bit 101 is selected from a plurality of generally short interchangeable male bits 101–103, 301–303 in one variant. In another variant (FIG. 18), male bits are relatively long allowing for the application of torque to fasteners 700 or bolts 900 that are diposed deep within wells of engine assemblies and the like.

Figure 15:
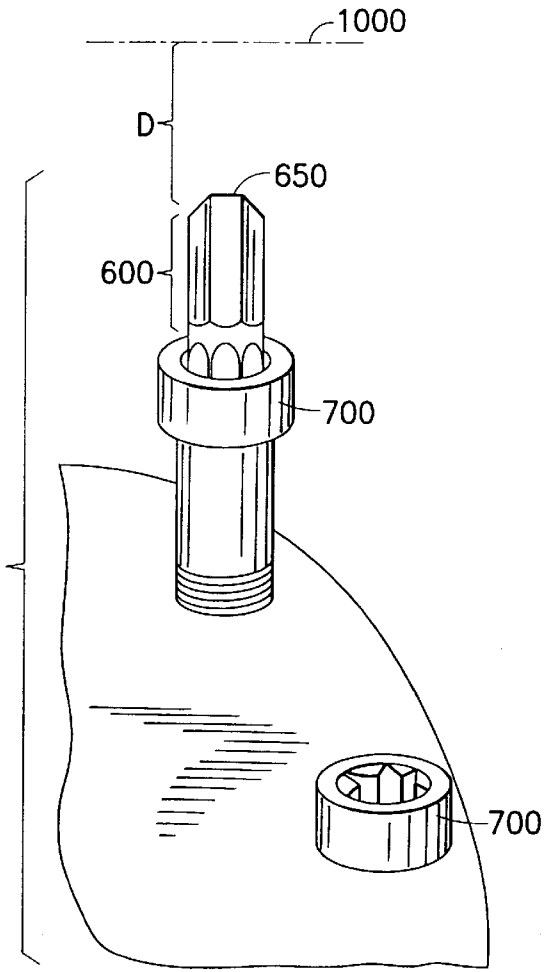
FIG. 15 is a diagram illustrating the male bit of FIG. 14 inserted into the fastener of FIG. 14.

Each bit 101–103 and 301–303 has a different sized male engaging portion 602 for easy entry into tight spaces. The bit 101 is inserted into female fastener recess 701 which is compatible with desired male engaging portion 602 to substantially enclose the male engaging portion 602 in the female fastener recess 701 to obtain an exposed male bit retaining portion 600' as illustrated in FIG. 15.

Figure 16:
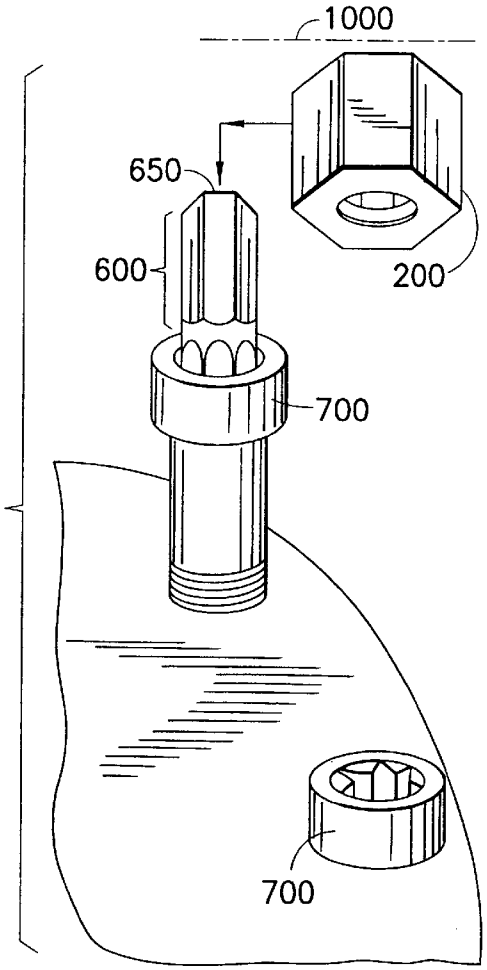
FIG. 16 is a diagram illustrating the female bit retaining member of FIG. 1 being mounted on the exposed portion of the male bit of FIG. 15 to obtain a female bit retaining member assembly.
Figure 17:
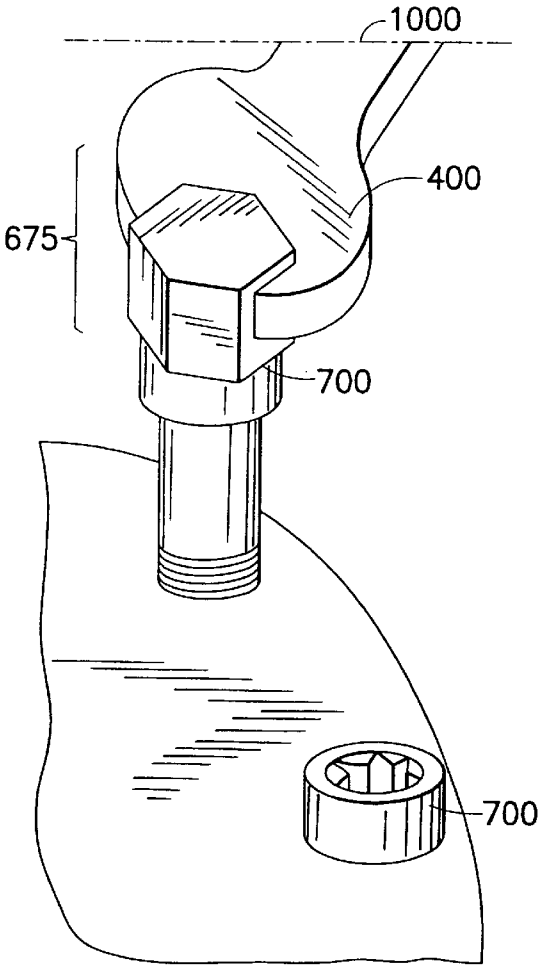
FIG. 17 is a diagram illustrating the female bit retaining member assembly of FIG. 16 having torque applied thereto with a tool.

Female bit retaining member 200 is introduced between obstruction 1000 and the top 650 of exposed male bit retaining portion 600' onto the exposed male bit retaining portion 600' as illustrated in FIG. 16 to obtain a female bit retaining member assembly 675 as illustrated in FIG. 17. It is appreciated that since portion 602 is inserted deep within recess 701 distance D between top 650 and obstruction 1000 is increased thereby providing for increase clearance space between the obstruction 1000 and top 650. The increased clearance space allows for the insertion of female bit retaining member 200 into the clearance space between top 650 and obstruction 1000.

As illustrated in FIG. 17, a torque is applied with tool 400 to female bit retaining member assembly 675 to rotate fastener 700. The maximum height D (FIG. 15) required to insert and utilize tool 400 that applies torque to fastener 700 in a limited clearance area A (FIG. 14) is less than the maximum height required to insert and utilize conventional devices that combine a hex head permanently mounted to a male bit. Hence, limited access problems associated with permanently mounted male bits are substantially alleviated.

Preferably, the steps of inserting, mounting and applying are conducted sequentially in the order referenced herein. Optionally, the step of positioning tool 400 onto female retaining member assembly 675 includes the use of substantially circular flange guide 220 as described above (FIGS. 6–7) connected to female retaining member assembly 675 or female tool retaining member 200. In this variant, the step of manually rotating the female retaining member assembly 675 is executed prior to the step of applying a torque with tool 400.

Figure 18:
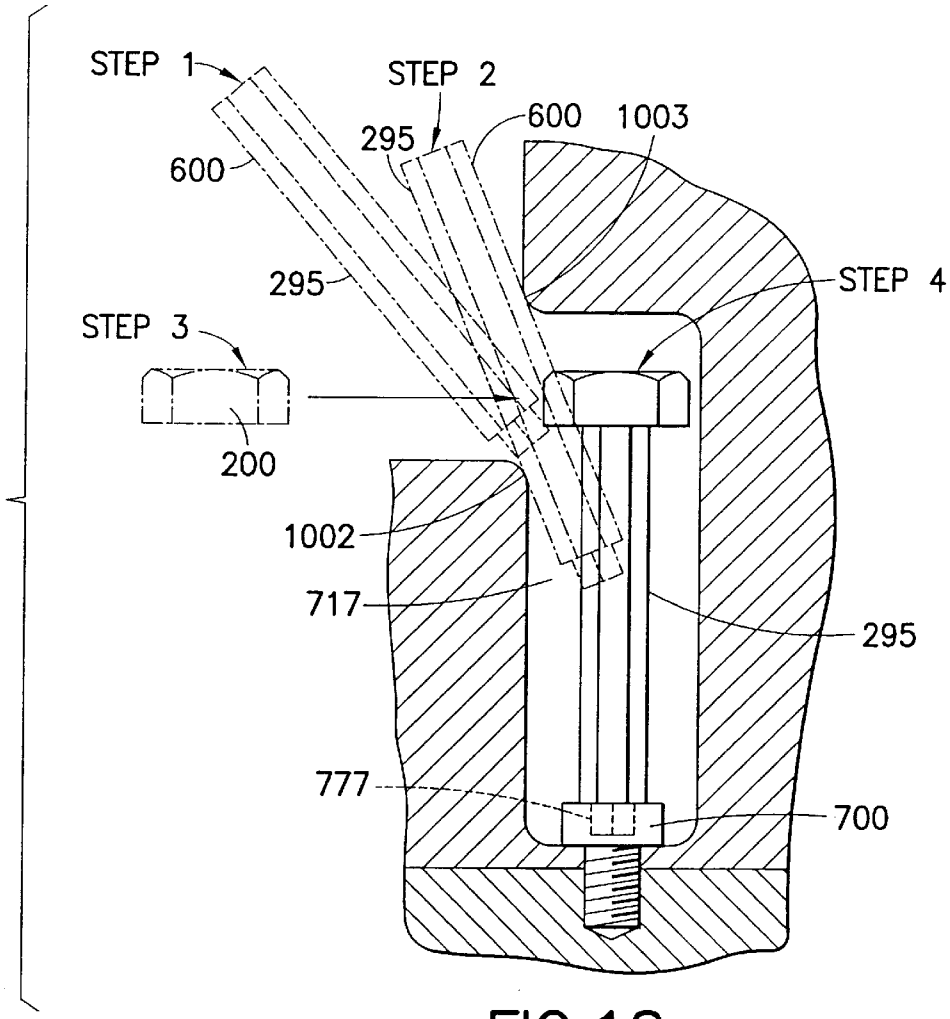
FIG. 18 is a diagram illustrating the use of a female bit retaining member assembly of the present invention where an obstruction exists.
Figure 19:
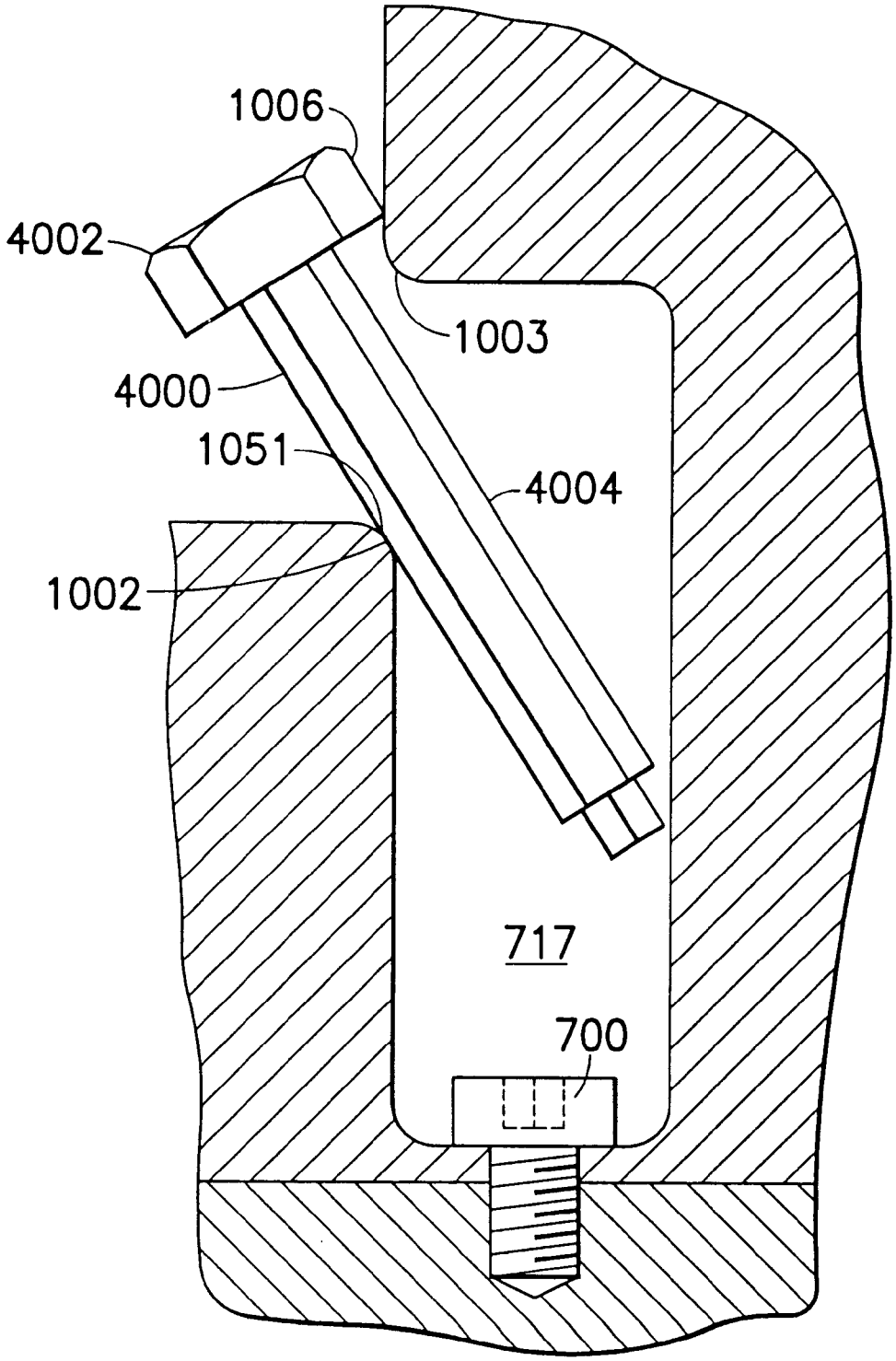
FIG. 19 PRIOR ART
FIG. 19 is a diagram illustrating a prior art.

FIG. 18 illustrates a variant of the method of the present invention in which male bit 295 is substantially longer than male bits 101–103 and 301–303. Substantially longer male bit 295 has a length in the range of 1.5 inches to 48 inches in length although different lengths are also contemplated herein. This type of bit is used to access fastener 700 or bolt 715 disposed in cavity 717. As illustrated by the phantom lines in FIG. 18, bit 295 is first positioned past obstructions 1002 and 1003 into cavity or well 717 into bolt recess 777. It is appreciated that the male bit 295 readily clears the obstructions 1002 and 1003 since the male bit retaining portion 600 is free of large permanently fixed perpendicular protuberances extending from the male bit 295 that would catch on obstructions 1002 and 1003. As in the method described above, once the male bit 295 is positioned in bolt recess 777, female bit retaining member 200 is then positioned onto the male bit 295 and the method steps as described above are executed. By way of example, large protuberances are generally larger than 10% of the maximum width of the male retaining portion 600. In this connection, see illustration of FIG. 19 representing the prior art where tool bit 4000 with hex head 4002 and hex shank 4004 is impeded at sides or edges 1006 and 1007 by the obstructions 1002 and 1003, respectively of cavity 717 in the apparatus being worked on.

The female member 200 and the male bits 101–103 and 301–303 of the present invention have a hardness range of from about 53 to about 57 Rockwell C scale, and are made from an alloy steel having properties of desired strength and toughness, as well as requisite flexibility. A more preferred hardness range, on the other hand, is from about 54 to about 55 Rockwell C scale, using an oil-hardening alloy spring steel having relatively higher amounts of silicon and manganese than other plain carbon tools or alloy tool steels.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

What is claimed is:

1. A torque transmitting tool set for use in a limited access space comprising in combination:

a plurality of drive members, each said drive member being integrally formed with a driver distal end and a driver proximate end, and comprising a polygonal male member portion formed at the proximate end and a tool element drive portion formed at the distal end, each male member portion having the same cross dimension and each drive portion having a different cross dimension for engaging a different cross-dimensioned tool element, each male member portion having a height, and a female member comprising a proximate end and a distal end, and having a polygonally shaped torque wrench receiving exterior, said proximate and distal ends of said female member comprising parallel planar surfaces, and being formed with a hole disposed between the parallel planar surfaces, said female member having a height measured between the parallel planar surfaces, said female member hole interchangeably receiving each respective male member portion to provide a height from the proximate end surface of the female member to each driver distal end, wherein with a drive member received in said female member a plane parallel to said planer surfaces bisects the female member wrench receiving exterior and the male member portion of each drive member, and the female member height being no greater than said male member portion height whereby the female member with each respective drive member operably accesses a limited clearance space for transmission of torque.

2. The tool set of claim 1, further comprising an annularly shaped flange integral with the female distal end planar surface.

3. The torque transmitting tool set of claim 1, wherein the female member substantially encloses the male retaining member portion for each respective drive member.

4. The torque transmitting tool set of claim 1, said polygonal male member portion of each said drive member and said female member hole having the same cross dimension.

5. The torque transmitting tool set of claim 1, wherein one said drive member drive portion cross dimension being greater than said male member portion cross dimension, and one other said drive member drive portion cross dimension being less than said male member portion cross dimension.

6. The torque transmitting tool set of claim 1, wherein the set consists of at least 3 drive members and only 1 female member.

7. The torque transmitting tool set of claim 1, further comprising a flange, said flange being integral with one planar surface of the female member.

8. The torque transmitting tool set of claim 1, said hole extending from one planar surface to the other planar surface.

9. A torque transmitting tool set for use in a limited access space comprising in combination:

a plurality of drive members, each said drive member being integrally formed with a driver distal end and a driver proximate ends and comprising a polygonal male member portion formed at the proximate end and a tool element drive portion formed at the distal end, each male member portion having the same cross dimension and each drive portion having a different cross dimension for engaging a different cross-dimensioned tool element, and a female member comprising a proximate end and a distal end, and having a polygonally shaped torque wrench receiving exterior, said proximate and distal ends of said female member comprising oppositely disposed surfaces and being formed with a hole disposed between the surfaces, said female member hole interchangeably receiving each respective male member portion to provide a height from the proximate end of the female member to each driver distal end, wherein with a drive member received in the female member a plane parallel to said oppositely disposed surfaces bisects the female member wrench receiving exterior and the male member portion of each drive member, whereby the female member with each respective drive member operably accesses a limited clearance space for transmission of torque.

10. The torque transmitting tool set of claim 9, further comprising a flange, said flange being integral with one surface of the female member.

11. The torque transmitting tool set of claim 9, said hole extending from surface to the other surface.

* * * * *